United States Patent [19]

Ishii

[11] Patent Number: 4,790,050

[45] Date of Patent: Dec. 13, 1988

[54] PULL TAB FOR SLIDE FASTENER SLIDER

[75] Inventor: Susumu Ishii, Kurobe, Japan

[73] Assignee: Yoshida Kogyo K. K., Tokyo, Japan

[21] Appl. No.: 174,439

[22] Filed: Mar. 28, 1988

[30] Foreign Application Priority Data

Apr. 13, 1987 [JP] Japan ..... 62-54658[U]

[51] Int. Cl.[4] ..... A44B 19/30

[52] U.S. Cl. ..... 24/429; 24/419; 24/236

[58] Field of Search ..... 24/429, 419, 236, 437, 24/403, 387, 230.5 R; 294/3.6

[56] References Cited

U.S. PATENT DOCUMENTS

| | | | |
|---|---|---|---|
| 1,939,346 | 12/1933 | Green | 24/230.5 R |
| 2,240,704 | 5/1941 | Lange | 24/419 |
| 2,497,740 | 2/1950 | Poux | 294/3.6 |
| 2,634,486 | 4/1953 | Morin | 24/419 |
| 4,389,758 | 6/1983 | Akashi | 24/429 |
| 4,512,064 | 4/1985 | Nishikawa | 24/429 |

FOREIGN PATENT DOCUMENTS

| | | | |
|---|---|---|---|
| 2803559 | 8/1979 | Fed. Rep. of Germany | 294/3.6 |
| 60-60912 | 4/1985 | Japan | 24/429 |
| 2069317 | 8/1981 | United Kingdom | 24/429 |

*Primary Examiner*—Victor N. Sakran

*Attorney, Agent, or Firm*—Hill, Van Santen, Steadman & Simpson

[57] ABSTRACT

A pull tab for a slide fastener slider is disclosed which comprises a first member made of a hard, rigid material and pivotally connected to the slider and a second member made of a soft, resilient material engageable through a plug and socket connection with the first member. The pull tab can be manipulated with utmost ease and security to the user.

6 Claims, 4 Drawing Sheets

PULL TAB FOR SLIDE FASTENER SLIDER

BACKGROUND OF THE INVENTION

1. Field of the Invention

This invention relates to a slider for a sliding clasp fastener and more particularly to a slider pull tab.

2. Description of the Prior Art

Numerous forms of slide fastener sliders have been proposed in the art, some of which were equipped with pull tabs of a slip-free design. One such slider is disclosed in Japanese Laid-Open Utility Model Publication No. 60-60912 in which the slider pull tab is made of metal, hard plastic or other hard and stiff material and has a coarsely surfaced, slip-resistant member engaged in an opening at its tip end. While this prior art slider is satisfactory in that it can be positively moved with fingers which are prevented from slipping off from the pull tab, it has a drawback in that since its pull tab is hard and rigid, the finger pressure applied to pull is hard to deflect vertically and imposes undue stresses on the slider body, and a further drawback in that being integral with the slider body, the pull tab when erected tends to injure the wearer and it is difficult to make available different forms of pull tabs tailored to meet with versatile customer's needs.

SUMMARY OF THE INVENTION

It is therefore the primary object of the present invention to provide a slider for a sliding clasp fastener which is equipped with such a pull tab which can be manipulated smoothly without undue stresses on the fingers of the user, which is free from physical injury upon the user, and which is capable of meeting with a versatility of customer needs.

The above and other object and features of the invention will be better understood from the following description taken in connection with the accompanying drawings which illustrate by way of example some preferred embodiments of the invention and in which like reference numerals refer to like or corresponding parts throughout the several views.

DETAILED DESCRIPTION OF THE INVENTION

Figure 1:
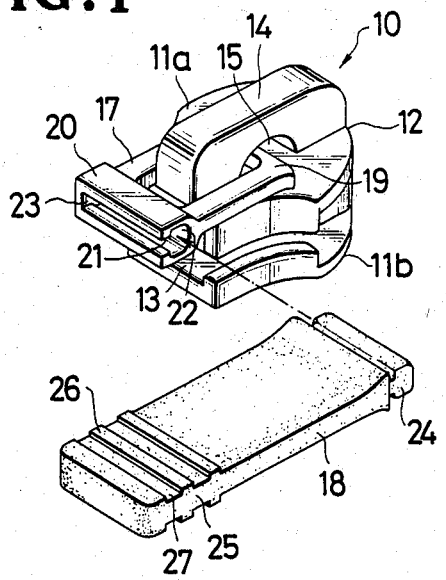
FIG. 1 is a perspective view of a slider embodying the invention.

Referring now to the drawings and FIG. 1 in particular, there is shown a slider 10 which comprises a slider body 11 including upper and lower wings 11*a*, 11*b* joined at their front end by a neck 12 so as to define a generally Y-shaped guide channel 13 for the passage of slide fastener stringers not shown. Designated at 14 is a support lug secured to the upper surface of the upper wing 11*a* and provided centrally with an aperture 15 for receiving one end of a pull tab hereafter described.

The pull tab designated at 16, which constitutes an important aspect of the invention, comprises a first member 17 made of a metal or hard plastics material and a second member 18 made of a soft, resilient material such as soft rubber, soft vinylchloride resin, soft polyurethane resin or the like. The first member 17 serves as a link connecting the second member 18 to the slider body 11, for which purpose it has a spindle 19 at the front end pivotally connected through the aperture 15 to the support lug 14. At the rear end of the first member 17, there is a socket 20 which has a cross-sectionally U-shaped transverse cavity 21 with one end open as at 22 and the other end 23 closed.

The second member 18 generally rectangular in shape has a plug 24 at one or front end which is formed complimentarily to and engageable through the U-shaped cavity 21 with the first member 17. At and adjacent to the other or rear end of the second member 18, there is provided a gripping zone 25 defined by alternate ridges 26 and grooves 27 which is adapted to be gripped with fingers, which can be done without slipping, to effect a sliding movement of the slider 10 along the fastener stringers.

Figure 2:
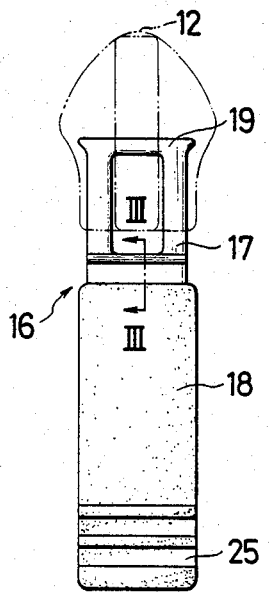
FIG. 2 is a plan view of the slider shown assembled with its pull tab.
Figure 3:
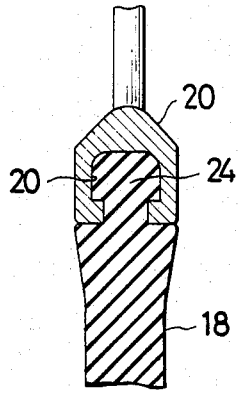
FIG. 3 is a cross-sectional view taken on the line III—III of FIG. 2.

The slider 10 of FIG. 1 is shown in FIG. 2 as assembled by inserting the plug 24 into the cavity 21 and the joint of the first and second member 17, 18 is better shown in FIG. 3, which is firm enough to prohibit the second member 18, should this be twisted, against detachment from the first member 17.

Figure 4:
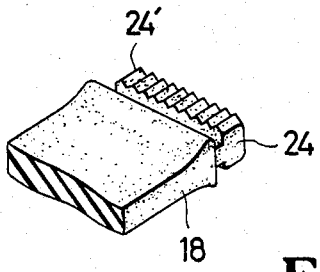
FIG. 4 is a perspective view of a portion of a modified form of pull tab.

The second member 18 shown in FIG. 4 has a somewhat different plug 24 which is provided with a saw-toothed surface 24' thereby enhancing its coupling strength.

Figure 5:
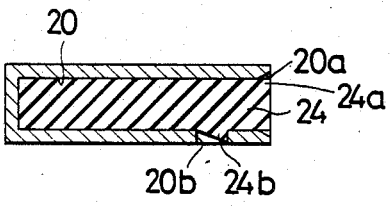
FIG. 5 is a cross-sectional view of a portion of another modified form of pull tab.

FIG. 5 shows a somewhat sophisticated form of the joint between the first member 17 and the second member 18 in which the socket 20 and the plug 24 are provided with tapered abutments 20*a* and 24*a* respectively and further with an aperture 20*b* and a protuberance 24*b*, respectively, the arrangement being that the plug 24 can be anchored stably in place within the socket 20.

Figure 6:
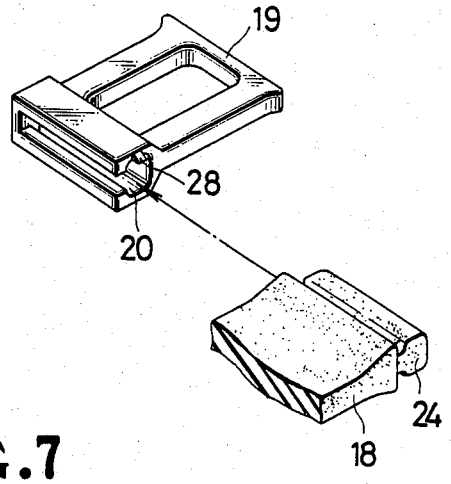
FIGS. 6–9 inclusive, each are perspective views of further different forms of pull tabs according to the invention.

A pull tab 16 shown in FIG. 6 is the same as that shown in FIG. 1 except that the socket 20 is provided at its open end 22 with a projection 28 adapted to be clamped over the plug 24, when the latter is inserted, so as to prevent the same from displacement.

Figure 7:
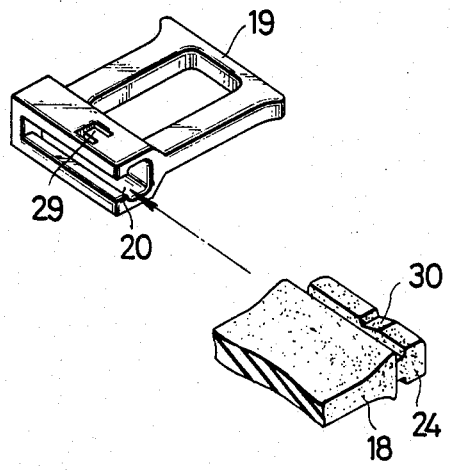

FIG. 7 shows a modification in which the socket 20 has a notch 29 adapted to be urged into a recess 30 in the plug 24 so as to hold the two pull tab members firmly together.

Figure 8:
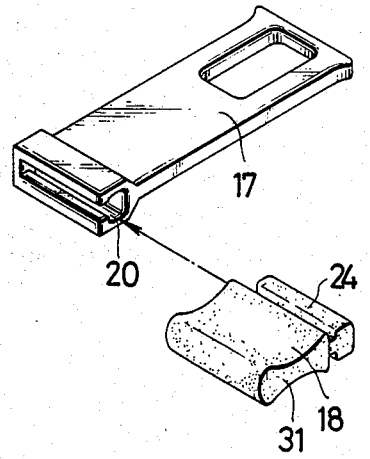

A modification of pull tab 16 shown in FIG. 8 has an elongated first member 17 and a shortened second member 18, the latter having inwardly curved surfaces to provide a gripping portion 31.

Figure 9:
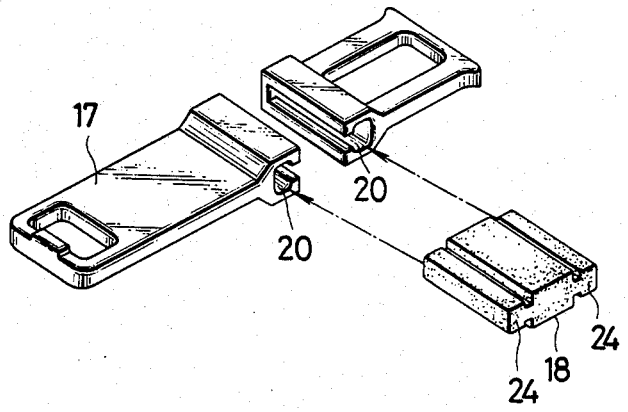

A modification shown in FIG. 9 is characterized by the provision of a pair of first members 17, 17 having identical sockets 20, 20 and a second member 18 having two identical plugs 24, 24 engageable with the respective sockets 20, 20.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A pull tab for a slide fastener slider which comprises a first member made of a metal or hard plastics material and pivotally connected to the slider and a second member made of a soft, resilient material, said first member having a socket and said second member having a plug engageable with said socket, said socket having a cross-sectionally generally U-shaped transverse cavity with one end open and the other end closed adapted to receive a complimentarily shaped plug.

2. A pull tab according to claim 1 wherein said plug has a saw-toothed surface.

3. A pull tab according to claim 1 wherein said socket and said plug are provided with tapered portions for mutual abutment and with an aperture and a protuberance, respectively.

4. A pull tab according to claim 1 wherein said socket has a projection adapted to be clamped over said plug.

5. A pull tab according to claim 1 wherein said socket has a notch engageable with a recess in said plug.

6. A pull tab according to claim 1 wherein said first member has a pair of identical sockets interconnected by a second member having two identical plugs.

* * * * *